US006758630B1

(12) United States Patent
Vega

(10) Patent No.: US 6,758,630 B1
(45) Date of Patent: Jul. 6, 2004

(54) SNOW AND ICE MELTING SYSTEM FOR ROADS

(76) Inventor: Marlene Vega, 320 East 156th St. #6G, Bronx, NY (US) 10451

( * ) Notice: Subject to any disclaimer, the term of this patent is extended or adjusted under 35 U.S.C. 154(b) by 0 days.

(21) Appl. No.: 09/468,515

(22) Filed: Dec. 21, 1999

Related U.S. Application Data

(60) Provisional application No. 60/116,428, filed on Jan. 20, 1999.

(51) Int. Cl.[7] ..... E01C 7/00

(52) U.S. Cl. ..... 404/71; 404/77; 404/79; 219/213

(58) Field of Search ..... 404/71, 77, 79; 219/213, 544, 497; 165/46

(56) References Cited

U.S. PATENT DOCUMENTS

| | | | | | |
|---|---|---|---|---|---|
| 3,807,886 A | * | 4/1974 | Cutler | 404/77 |
| 3,904,847 A | * | 9/1975 | Adams | 219/213 |
| 4,026,350 A | * | 5/1977 | Zembrzuski | 165/46 |
| 4,564,745 A | * | 1/1986 | Deschenes | 219/213 |
| 4,581,522 A | * | 4/1986 | Graham | 219/545 |
| 5,395,179 A | * | 3/1995 | Kotani | 404/71 |
| 5,643,482 A | * | 7/1997 | Sandelman et al. | 219/497 |

FOREIGN PATENT DOCUMENTS

| | | | | |
|---|---|---|---|---|
| DE | 2239993 | * | 2/1974 | 404/71 |
| DE | 3346520 | * | 7/1984 | 404/79 |
| FR | 464268 | * | 3/1990 | 404/71 |
| JP | 405051910 | * | 3/1993 | 404/71 |

* cited by examiner

*Primary Examiner*—Eileen Dunn Lillis
*Assistant Examiner*—Alexandra Pechhold
(74) *Attorney, Agent, or Firm*—Goldstein Law Offices, PC.

(57) ABSTRACT

A snow and ice melting system for roads including a system of heating coils disposed below an upper surface of a roadway. The system of coils are arranged in a serpentine configuration whereby a majority of a surface area of the roadway is in contact with the heating coils. A system of laser heaters are disposed within side surfaces of curbs of the roadway in a spaced relationship. The laser heaters direct a ray of heat over the upper surface of the roadway. A weather sensitive activation sensor is secured to a top surface of a traffic light. The activation sensor is in communication with the system of heating coils and the system of laser heaters.

4 Claims, 2 Drawing Sheets

SNOW AND ICE MELTING SYSTEM FOR ROADS

CROSS REFERENCES AND RELATED SUBJECT MATTER

This application relates to subject matter contained in provisional patent application serial No. 60/116,428, filed in the United States Patent & Trademark office on Jan. 20, 1999.

BACKGROUND OF THE INVENTION

The present invention relates to a snow and ice melting system for roads and more particularly pertains to melting ice and snow from roadways during severe weather with a snow and ice melting system for roads.

Electrically heated ground coverings made of concrete having electric heating wires embedded therein have long been known. These heated ground coverings are particularly useful for driveways, sidewalks, roads or other traffic bearing surfaces for the purpose of maintaining such surfaces free of ice and snow accumulation. Most systems require a person to manually activate the heating elements once ice and snow have already begun to accumulate on the surface. What is needed is a system that activates automatically once snow and ice begin to fall to begin the melting process and prevent any accumulation of ice and snow of the surface whatsoever.

The present invention provides an electrical system for roadways that will activate once snow and ice begin to fall thereby preventing the build-up of ice and snow that generally occurs.

The use of electrical means for heating surfaces is known in the prior art. More specifically, electrical means for heating surfaces heretofore devised and utilized for the purpose of preventing formation of ice and snow on surfaces are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,581,522, to Graham discloses an embedded mesh heating element capable of maintaining a temperature for the prevention of formation of ice on surfaces. U.S. Pat. No. 5,395,179 to Kotani discloses an electric snow melting device for a roadway comprised of a series of heat generating elements installed in the pavement. U.S. Pat. No. 5,643,482 to Sandelmann discloses the use of temperature sensors to control a snow and ice melting system for a slab. U.S. Pat. No. 4,564,745 to Deschenes discloses a pre-caste heating panel.

While these devices fulfill their respective, particular objective and requirements, the aforementioned patents do not describe a snow and ice melting system for roads for melting ice and snow from roadways during severe weather.

In this respect, the snow and ice melting system for roads according to the present invention substantially departs from the conventional concepts and designs of the prior art, and in doing so provides an apparatus primarily developed for the purpose of melting ice and snow from roadways during severe weather.

Therefore, it can be appreciated that there exists a continuing need for new and improved snow and ice melting system for roads which can be used for melting ice and snow from roadways during severe weather. In this regard, the present invention substantially fulfills this need.

SUMMARY OF THE INVENTION

In the view of the foregoing disadvantages inherent in the known types of electrical means for heating surfaces now present in the prior art, the present invention provides an improved snow and ice melting system for roads. As such, the general purpose of the present invention, which will be described subsequently in greater detail, is to provide a new and improved snow and ice melting system for roads and method which has all the advantages of the prior art and none of the disadvantages.

To attain this, the present invention essentially comprises a system of heating coils disposed below an upper surface of a roadway. The system of coils are arranged in a serpentine configuration whereby a majority of a surface area of the roadway is in contact with the heating coils. A system of laser heaters are disposed within side surfaces of curbs of the roadway in a spaced relationship. The laser heaters direct a ray of heat over the upper surface of the roadway. A weather sensitive activation sensor is secured to a top surface of a traffic light. The activation sensor is in communication with the system of heating coils and the system of laser heaters.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snow and ice melting system for roads which has all the advantages of the prior art electrical means for heating surfaces and none of the disadvantages.

It is another object of the present invention to provide a new and improved snow and ice melting system for roads which may be easily and efficiently manufactured and marketed.

It is a further object of the present invention to provide a new and improved snow and ice melting system for roads which is of durable and reliable construction.

An even further object of the present invention is to provide a new and improved snow and ice melting system for roads which is susceptible of a low cost of manufacture with regard to both materials and labor, and which accordingly is then susceptible of low prices of sale to the consuming public, thereby making such a snow and ice melting system for roads economically available to the buying public.

Even still another object of the present invention is to provide a new and improved snow and ice melting system for roads for melting ice and snow from roadways during severe weather.

Lastly, it is an object of the present invention to provide a new and improved snow and ice melting system for roads including a system of heating coils disposed below an upper surface of a roadway. The system of coils are arranged in a serpentine configuration whereby a majority of a surface area of the roadway is in contact with the heating coils. A system of laser heaters are disposed within side surfaces of curbs of the roadway in a spaced relationship. The laser heaters direct a ray of heat over the upper surface of the roadway. A weather sensitive activation sensor is secured to a top surface of a traffic light. The activation sensor is in communication with the system of heating coils and the system of laser heaters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
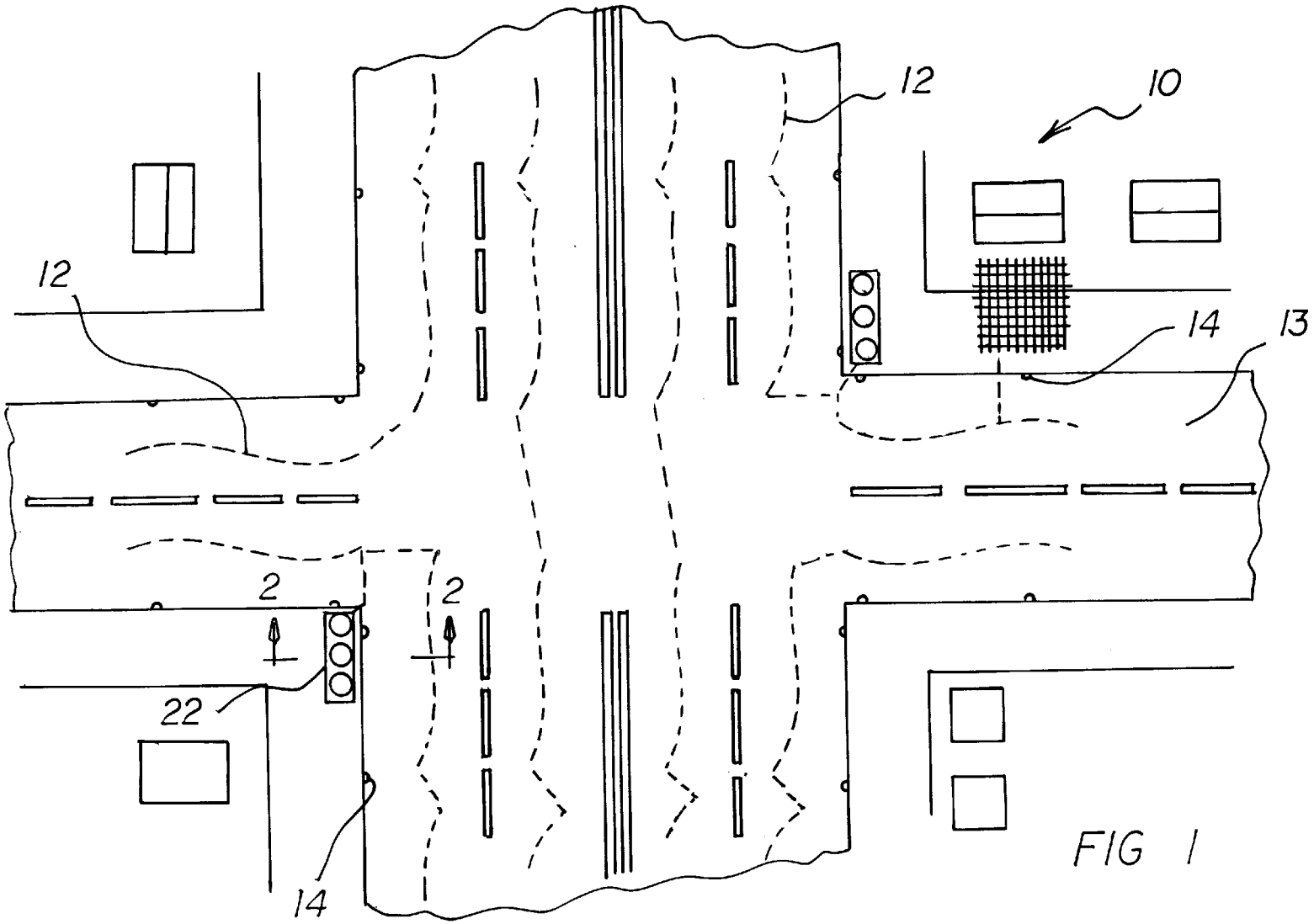
FIG. 1 is a plan view of the preferred embodiment of the snow and ice melting system for roads constructed in accordance with the principles of the present invention.
Figure 2:
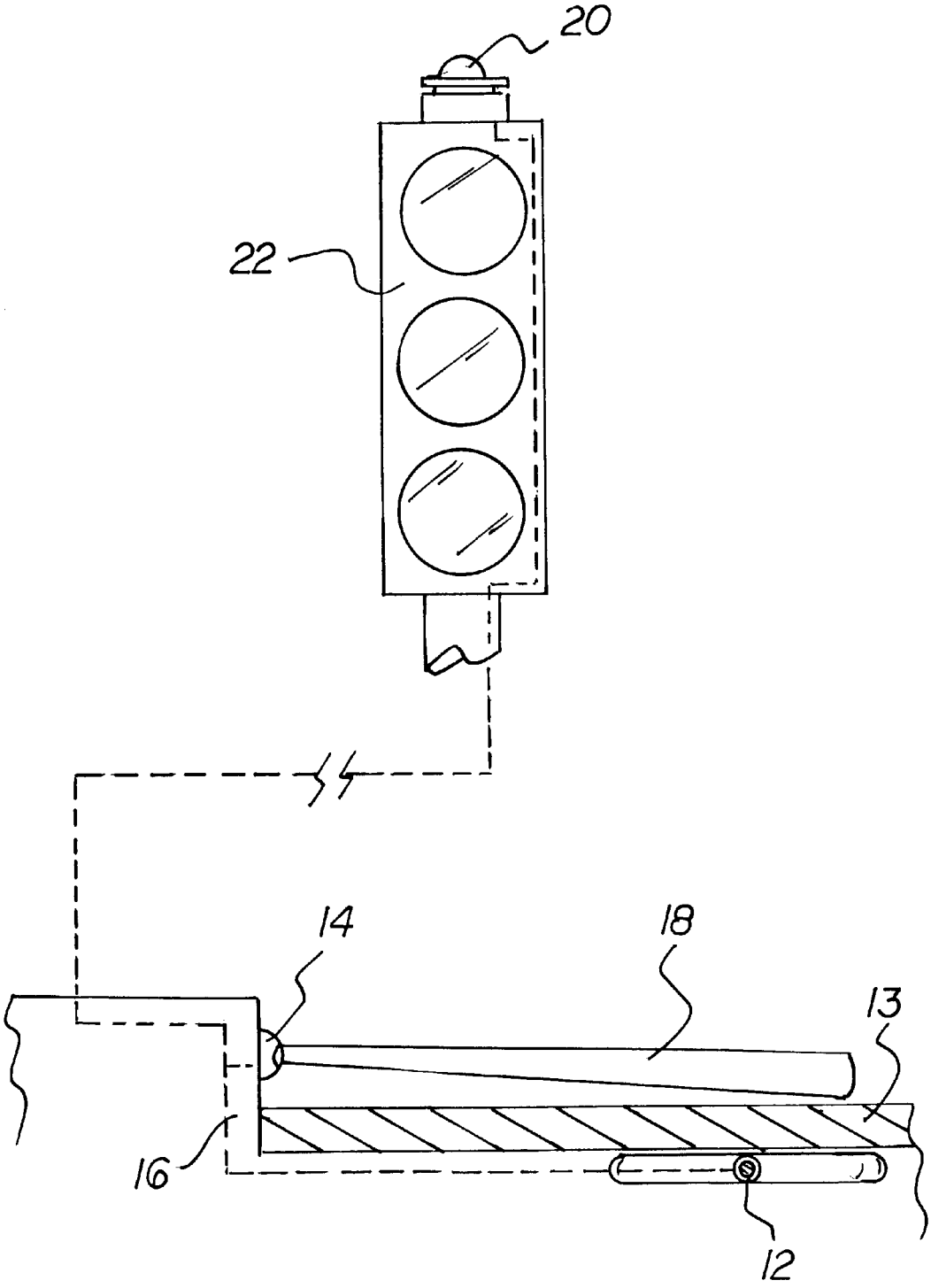
FIG. 2 is a cross-sectional view of the present invention as taken along line 2—2 of FIG. 1.

With reference now to the drawings, and in particular, to FIGS. 1 and 2 thereof, the preferred embodiment of the new and improved snow and ice melting system for roads embodying the principles and concepts of the present invention and generally designated by the reference number 10 will be described.

Specifically, it will be noted in the various Figures that the device relates to a snow and ice melting system for roads for melting ice and snow from roadways during severe weather. In its broadest context, the device consists of a system of heating coils, a system of laser heaters, and a weather sensitive activation sensor. Such components are individually configured and correlated with respect to each other so as to attain the desired objective.

The system of heating coils 12 are disposed below an upper surface of a roadway 13. The system of coils 12 are arranged in a serpentine configuration whereby a majority of a surface area of the roadway 13 is in contact with the heating coils 12. The coils 12 could be used in other surfaces where the prevention of build-up of ice and snow is desired.

The system of laser heaters 14 are disposed within side surfaces of curbs 16 of the roadway 13 in a spaced relationship. The laser heaters 16 direct a ray of heat 18 over the upper surface of the roadway 13. While the coils 12 will melt snow and ice from underneath the roadway 13, the laser heaters 14 will melt the snow and ice from the side and from above.

The weather sensitive activation sensor 20 is secured to a top surface of a traffic light 22. The activation sensor 20 is in communication with the system of heating coils 12 and the system of laser heaters 14. Once the sensor 20 reacts, the heating coils 12 and the laser heaters 14 will be activated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A snow and ice melting system for roads for melting ice and snow from roadways during severe weather comprising, in combination:

a system of heating coils disposed below an upper surface of a roadway, the system of coils being arranged in a serpentine configuration whereby a majority of a surface area of the roadway is in contact with the heating coils;

a system of laser heaters disposed within side surfaces of curbs of the roadway in a spaced relationship, the laser heaters directing a ray of heat over the upper surface of the roadway;

a weather sensitive activation sensor secured to a top surface of a traffic light, the activation sensor being in communication with the system of heating coils and the system of laser heaters.

2. A snow and ice melting system for roads for melting ice and snow from roadways during severe weather comprising, in combination:

a system of heating coils disposed below an upper surface of a roadway;

a system of laser heaters disposed within side surfaces of curbs of the roadway in a spaced relationship, the laser heaters directing a ray of heat over the upper surface of the roadway;

a weather sensitive activation sensor in communication with the system of heating coils and the system of laser heaters.

3. The snow and ice melting system for roads as set forth in claim 2 wherein the system of coils are arranged in a serpentine configuration whereby a majority of a surface area of the roadway is in contact with the heating coils.

4. The snow and ice melting system for roads as set forth in claim 2 wherein the weather sensitive activation sensor is secured to a top surface of a traffic light.

* * * * *